US009858895B2

(12) United States Patent
Li et al.

(10) Patent No.: US 9,858,895 B2
(45) Date of Patent: Jan. 2, 2018

(54) METHOD FOR ADJUSTING SCREEN BRIGHTNESS AND SYSTEM THEREOF

(71) Applicant: HuiZhou TCL Mobile Communication Co., Ltd., HuiZhou (CN)

(72) Inventors: Cansong Li, HuiZhou (CN); Jinyi Zhao, HuiZhou (CN)

(73) Assignee: HuiZhou TCL Mobile Communication Co., Ltd., HuiZhou (CN)

( * ) Notice: Subject to any disclaimer, the term of this patent is extended or adjusted under 35 U.S.C. 154(b) by 0 days.

(21) Appl. No.: 15/101,108

(22) PCT Filed: Oct. 16, 2015

(86) PCT No.: PCT/CN2015/092125
§ 371 (c)(1),
(2) Date: Jun. 2, 2016

(87) PCT Pub. No.: WO2016/176966
PCT Pub. Date: Nov. 10, 2016

(65) Prior Publication Data

US 2017/0116959 A1 Apr. 27, 2017

(30) Foreign Application Priority Data

May 5, 2015 (CN) ..... 2015 1 0222770

(51) Int. Cl.
*G09G 5/10* (2006.01)

(52) U.S. Cl.
CPC ..... *G09G 5/10* (2013.01); *G09G 2320/0646* (2013.01)

(58) Field of Classification Search
CPC ..... G09G 5/10; G09G 2320/0626
USPC ..... 345/589, 690
See application file for complete search history.

(56) References Cited

U.S. PATENT DOCUMENTS

| | | | | |
|---|---|---|---|---|
| 8,544,056 | B2 * | 9/2013 | Ohno | H04N 5/45 348/564 |
| 2002/0047590 | A1 * | 4/2002 | Kawano | G06F 9/4443 315/169.4 |
| 2003/0142085 | A1 * | 7/2003 | Taniguchi | G09G 3/3406 345/204 |
| 2004/0130555 | A1 * | 7/2004 | Ko | G09G 5/02 345/589 |
| 2005/0200868 | A1 | 9/2005 | Yoshida | |

(Continued)

FOREIGN PATENT DOCUMENTS

| | | |
|---|---|---|
| CN | 101609649 | 12/2009 |
| CN | 102262536 | 11/2011 |
| CN | 104869242 | 8/2015 |

*Primary Examiner* — Barry Drennan
*Assistant Examiner* — Phong Nguyen

(57) ABSTRACT

A method for adjusting screen brightness and system thereof are described. The method comprises: acquiring an attribute parameter of a screen image and a current screen brightness in a smartphone; comparing the attribute parameter of the screen image of the smartphone to the current screen brightness; and decreasing a screen display brightness when the attribute parameter is greater than the screen brightness; and increasing the screen display brightness when the attribute parameter is less than the screen brightness.

6 Claims, 7 Drawing Sheets

(56) References Cited

U.S. PATENT DOCUMENTS

2006/0182366 A1* 8/2006 Hsu ..... H04N 5/20 382/274
2007/0279373 A1* 12/2007 Tseng ..... G09G 3/3406 345/102
2007/0285569 A1* 12/2007 Nakamura ..... H04N 5/58 348/564
2008/0055228 A1* 3/2008 Glen ..... G09G 3/3406 345/102
2008/0117323 A1* 5/2008 Sakamoto ..... G06F 3/011 348/333.01
2008/0252628 A1* 10/2008 Han ..... G09G 5/10 345/207
2008/0316349 A1* 12/2008 Toyoda ..... H04N 5/2351 348/333.01
2009/0278828 A1* 11/2009 Fletcher ..... G06F 1/3203 345/207
2011/0298843 A1* 12/2011 Hajjar ..... G09G 5/10 345/690
2012/0182275 A1* 7/2012 Chen ..... G09G 5/10 345/207
2013/0082993 A1* 4/2013 Kim ..... G09G 5/10 345/207
2013/0271475 A1* 10/2013 Aruga ..... G06T 1/00 345/520
2014/0176518 A1* 6/2014 Min ..... G09G 3/20 345/207
2014/0320552 A1* 10/2014 Seo ..... G09G 3/3648 345/690
2015/0042696 A1* 2/2015 Ooga ..... G09G 3/3406 345/690
2015/0269709 A1* 9/2015 Zhao ..... G06T 3/4092 345/589
2016/0028965 A1* 1/2016 Horii ..... H04N 5/225 348/333.01
2016/0180801 A1* 6/2016 Lee ..... H04M 1/72569 345/156
2016/0284279 A1* 9/2016 Li ..... G09G 3/3406
2016/0293139 A1* 10/2016 Kwon ..... G09G 5/02
2017/0079118 A1* 3/2017 Chen ..... G06F 3/14

* cited by examiner

METHOD FOR ADJUSTING SCREEN BRIGHTNESS AND SYSTEM THEREOF

RELATED APPLICATIONS

This application is a National Phase of PCT Patent Application No. PCT/CN2015/092125 having International filing date of Oct. 16, 2015, which claims the benefit of priority of Chinese Patent Application No. 201510222770.5 filed on May 5, 2015. The contents of the above applications are all incorporated by reference as if fully set forth herein in their entirety.

FIELD AND BACKGROUND OF THE INVENTION

The present invention relates to a technical field of adjusting screen brightness of a mobile terminal, and more particularly to a method for adjusting screen brightness and system thereof.

Conventionally, a smartphone is increasingly used in daily-life applications and the user squints at the screen of the smartphone for a long time. When the screen brightness or color tone of the smartphone is unsuitable for the user, the discomfort sensation will stimulates the user's eyes. Although the smartphone is able to automatically adjust the screen brightness based on the outer environment light intensity, however, the brightness, color tone and contrast ratio of the smartphone display content thereon are different in the same outer environment light intensity, which also stimulates the user's eyes. Thus, the conventional adjustment to the screen brightness of the smartphone based on the outer environment light intensity cannot effectively protect the user's eyes.

Consequently, there is a need to improve the conventional techniques and develop a novel system.

SUMMARY OF THE INVENTION

Based on the above-mentioned drawbacks, one objective of the present invention is to provide a method for adjusting screen brightness and system thereof so that the screen brightness is intelligently adjusted to protect the user's eyes when the user operates the smartphone.

For the above-mentioned objective, the present invention employs the following technical schemes.

A method for adjusting screen brightness, the method comprising the steps of:

assigning a fixed identification (ID) number to each of a plurality of images in a system and storing an attribute parameter of each image;

acquiring a current procedure on the screen executed by a user and a screen brightness;

determining whether the current procedure executed by the user is an image-browsing procedure;

acquiring the ID number of the image and acquiring the attribute parameter corresponding to the image based on the ID number of the image if the current procedure executed by the user is the image-browsing procedure;

acquiring the attribute parameter of a screenshot if the current procedure executed by the user is not the image-browsing procedure;

comparing the attribute parameter to the screen brightness;

decreasing a screen display brightness for equalizing the attribute parameter of the image after a parameter adjustment to the screen brightness before a brightness adjustment when the attribute parameter is greater than the screen brightness; and increasing the screen display brightness for equalizing the attribute parameter after the parameter adjustment to the screen brightness before the brightness adjustment when the attribute parameter is less than the screen brightness.

The method for adjusting screen brightness, during the step of acquiring the attribute parameter of the screenshot if the current procedure executed by the user is not the image-browsing procedure, further comprises the steps of:

calling a screen image-capturing procedure at predetermined intervals to capture the screenshot;

storing the captured screenshot in a secure digital (SD) card;

acquiring the attribute parameter of the captured screenshot; and canceling the captured screenshot.

In the method for adjusting screen brightness, the attribute parameter comprises a contrast ratio, a color tone and a brightness.

A method for adjusting screen brightness, the method comprising the steps of:

acquiring an attribute parameter of a current screen image and a screen brightness;

comparing the attribute parameter of the current screen image to the screen brightness; and decreasing a screen display brightness for equalizing the attribute parameter of the current screen image after a parameter adjustment to the screen brightness before a brightness adjustment when the attribute parameter of the current screen image is greater than the screen brightness; and increasing the screen display brightness for equalizing the attribute parameter of the current screen image after the parameter adjustment to the screen brightness before the brightness adjustment when the attribute parameter of the current screen image is less than the screen brightness.

The method for adjusting screen brightness, before the step of acquiring the attribute parameter of the current screen image and the screen brightness, further comprises the step of:

assigning a fixed ID number to each of a plurality of images in a system and storing the attribute parameter corresponding to the ID number of each image.

The method for adjusting screen brightness, during the step of acquiring the attribute parameter of the current screen image, further comprises the steps of:

acquiring a current procedure on the screen executed by a user and the screen brightness and determining whether the current procedure executed by the user is an image-browsing procedure;

acquiring the ID number of the current screen image and acquiring the attribute parameter corresponding to the current screen image based on the ID number of the current screen image if the current procedure executed by the user is the image-browsing procedure; and acquiring the attribute parameter of a screenshot if the current procedure executed by the user is not the image-browsing procedure.

The method for adjusting screen brightness, during the step of acquiring the attribute parameter of the screenshot if the current procedure executed by the user is not the image-browsing procedure, further comprises the steps of:

calling a screen image-capturing procedure at predetermined intervals to capture the screenshot;

storing the captured screenshot in a SD card;

acquiring the attribute parameter of the captured screenshot; and canceling the captured screenshot.

In the method for adjusting screen brightness, wherein the attribute parameter of the current screen image comprises a contrast ratio, a color tone and a brightness.

A system for adjusting screen brightness, the system comprising:

an acquisition module, for acquiring an attribute parameter of a current screen image and a screen brightness;

a parameter comparison module, for comparing the attribute parameter of the current screen image to the screen brightness; and a brightness adjustment module, decreasing a screen display brightness for equalizing the attribute parameter of the current screen image after a parameter adjustment to the screen brightness before a brightness adjustment when the attribute parameter of the current screen image is greater than the screen brightness; and increasing the screen display brightness for equalizing the attribute parameter of the current screen image after the parameter adjustment to the screen brightness before the brightness adjustment when the attribute parameter of the current screen image is less than the screen brightness.

The system for adjusting screen brightness further comprises:

a parameter storing module, for assigning a fixed ID number to each of a plurality of images and for storing the attribute parameter of each image before acquiring the attribute parameter of the current screen image and the screen brightness.

In the system for adjusting screen brightness, the acquisition module further comprises:

a decision unit, for acquiring a current procedure on a screen executed by a user to determine whether the current procedure executed by the user is an image-browsing procedure;

a first parameter acquisition unit, for acquiring the ID number of the current screen image and for acquiring the attribute parameter corresponding to the current screen image based on the ID number of the current screen image if the current procedure executed by the user is the image-browsing procedure; and a second parameter acquisition unit, for acquiring the attribute parameter of a screenshot if the current procedure executed by the user is not the image-browsing procedure.

In the system for adjusting screen brightness, the second parameter acquisition unit further comprises:

a screen image-capturing unit, for calling a screen image-capturing procedure at predetermined intervals to capture the screenshot;

a screen image-storing unit, for storing the captured screenshot in a SD card;

a screenshot attribute parameter acquisition unit, for acquiring the attribute parameter of the captured screenshot; and a screenshot canceling unit, for canceling the captured screenshot.

In the system for adjusting screen brightness, the attribute parameter of the current screen image comprises a contrast ratio, a color tone and a brightness.

A storage medium storing instructions thereon which are executed by a processor, wherein the instructions executed by the processor performs the operations of:

acquiring an attribute parameter of a current screen image and a screen brightness;

comparing the attribute parameter to the screen brightness; and decreasing a screen display brightness for equalizing the attribute parameter after a parameter adjustment to the screen brightness before a brightness adjustment when the attribute parameter is greater than the screen brightness; and increasing the screen display brightness for equalizing the attribute parameter after the parameter adjustment to the screen brightness before the brightness adjustment when the attribute parameter is less than the screen brightness.

In the storage medium storing instructions thereon which are executed by the processor, before the processor performs the operation of acquiring the attribute parameter of the current screen image and the screen brightness, the processor further performs the operation of:

assigning a fixed ID number to each of a plurality of images in a system and storing the attribute parameter of each image.

In the storage medium storing instructions thereon which are executed by the processor, when the processor performs the operation of acquiring the attribute parameter of the current screen image, the processor further performs the operations of:

acquiring a current procedure on the screen executed by a user and determining whether the current procedure executed by the user is an image-browsing procedure;

acquiring the ID number of the current screen image and acquiring the attribute parameter corresponding to the current screen image based on the ID number of the current screen image if the current procedure executed by the user is the image-browsing procedure; and acquiring the attribute parameter of a screenshot if the current procedure executed by the user is not the image-browsing procedure.

In the storage medium storing instructions thereon which are executed by the processor, when the processor performs the operation of fetching the attribute parameter of the screenshot, the processor further performs the operations of:

calling a screen image-capturing procedure at predetermined intervals to capture the screenshot;

storing the captured screenshot in a SD card;

acquiring the attribute parameter of the captured screenshot; and canceling the captured screenshot.

In the storage medium, the attribute parameter of the current screen image comprises a contrast ratio, a color tone and a brightness.

The present invention includes the advantages as follows. The present invention acquires screen image or screenshot of the smartphone. If the user is browsing the image, the ID number of the image is acquired to fetch the corresponding image attribute parameter. If the user is not browsing the image, the screenshot image is captured at predetermined intervals, the attribute parameter of the screenshot is fetched and the screenshot image is then canceled. The attribute parameter of the acquired screen image of the smartphone is compared to the current screen brightness. When the value of the current screen image attribute parameter is greater than the screen brightness, the screen display brightness is decreased and when the value of the current screen image attribute parameter is less than the screen brightness, the screen display brightness is increased. These assure that the screen brightness is intelligently adjusted based on the user's browsing content to modify the screen brightness to best suit user's viewing brightness in order to protect the user's eyes when the user utilizes the smartphone.

DESCRIPTION OF SPECIFIC EMBODIMENTS OF THE INVENTION

The following embodiments refer to the accompanying drawings for exemplifying specific implementable embodiments of the present invention. It should be noted that the exemplary described embodiments are used to describe and understand the present invention, but the present invention is not limited thereto.

Figure 1:
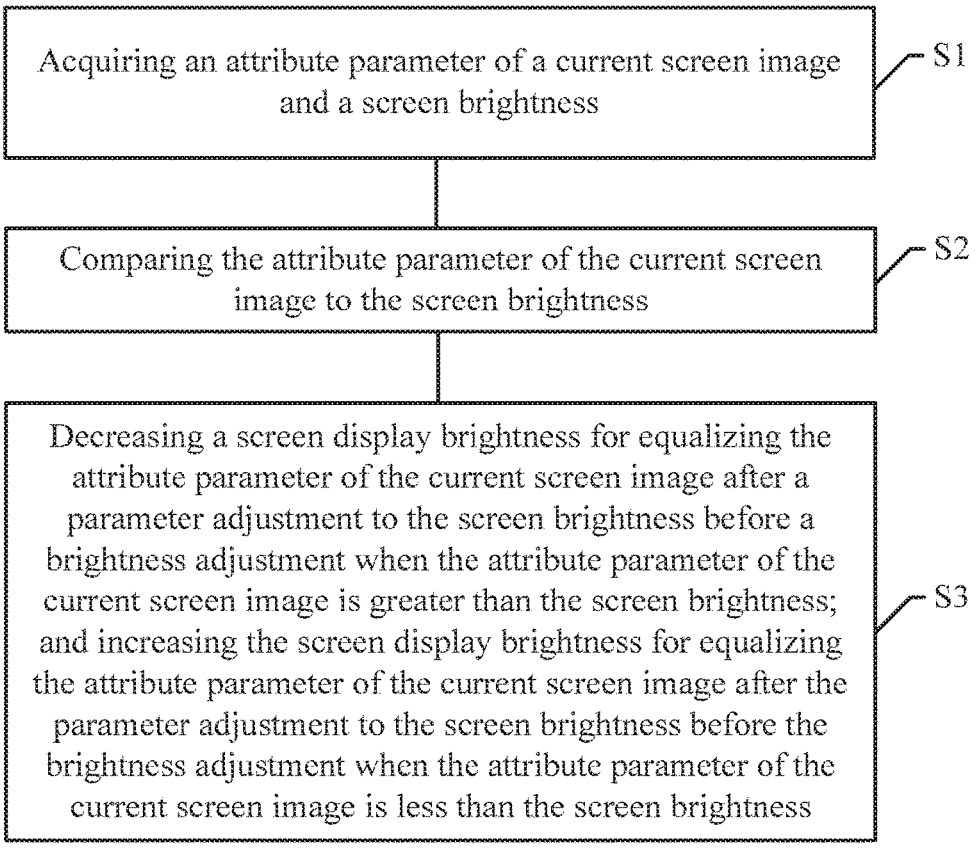
FIG. 1 is a flow chart of a method for adjusting the screen brightness according to one embodiment of the present invention.

Please refer to FIG. 1, which is a flow chart of a method for adjusting the screen brightness according to one embodiment of the present invention. The method for adjusting the screen brightness comprises the following steps.

In the step S1, an attribute parameter of a current screen image and the screen brightness are acquired.

In the step S2, the attribute parameter of the current screen image is compared to the screen brightness;

In the step S3, a screen display brightness associated with the attribute parameter is decreased for equalizing the attribute parameter of the current screen image after a parameter adjustment to the screen brightness before a brightness adjustment when the attribute parameter of the current screen image is greater than the screen brightness. The screen display brightness is increased for equalizing the attribute parameter of the current screen image after the parameter adjustment to the screen brightness before the brightness adjustment when the attribute parameter of the current screen image is less than the screen brightness.

In the method of adjusting the screen brightness according to one embodiment of the present invention, the current screen image attribute parameter and screen brightness are firstly acquired. In other words, the attribute parameter of the current image on the screen is fetched wherein the attribute parameter of the current image is different from the brightness of the screen itself. When the screen displays in a brightness level, the image with either an excessive dark or colorful status on the screen will affect the user's eyes and thus stimulate the user's eyes. After the screen image attribute parameter and the screen brightness are acquired, the current screen image attribute parameter is compared to the screen brightness. If the comparison result indicates that the screen image attribute parameter is greater than the screen brightness, the current image may stimulate the user's eyes and thus the screen display brightness associated with the attribute parameter is decreased. If the comparison result indicates that the screen image attribute parameter is less than the screen brightness, the image on the screen is too dark and thus the screen display brightness associated with the attribute parameter is increased in order to protect the user's eyes. In order to protect the user's eyes, the method for adjusting the screen brightness acquires the attribute parameter of the screen image which serves as an adjustment reference of the screen brightness. The stimulation extent of the image to the user's eyes is related to three kinds of parameters, i.e. the brightness, the color tone and the contrast ratio of the image. The image brightness comprises a value range from 0 to 255 wherein as the value raises, the higher the brightness becomes. Furthermore, the image color is represented by the color tone average of the image wherein each color tone calculated by three primary color components, i.e. red, green and blue colors. The present invention acquires each value of the three primary color components which comprises a value range from 0 to 255. If the color tone average of an image is low but the contrast ratio of the image is very high, i.e. the brightness difference is bigger, it will result in visual fatigue. In one embodiment, the ratio of 120 to 1 is an ideal contrast ratio. Basically, the three parameters are capable of determining the stimulation extent of the image to the user's eyes. First, the brightness "bright_value[ ]", which is equal to the screen brightness, is read and there is no need to convert the brightness value. Second, the color tone is read and the value 125 is defined as an intermediate value wherein an excessive or inadequate portion in relative to the intermediate value is converted to the brightness at 30%. Third, the contrast ratio is read and the ratio 120:1 is defined as an intermediate value wherein an excessive or inadequate portion in relative to the intermediate ratio value is converted to the brightness at 20%. Finally, the three equivalent brightness values are compared to the current screen brightness for adjusting the screen display brightness based on the compared result so that the image attribute parameter after the parameter adjustment is equal to the screen brightness before the brightness adjustment. Since the screen brightness before the brightness adjustment is defined as the better screen display image, it is only required to adjust the image attribute parameter on the screen to reach the screen brightness before the brightness adjustment when the image is in an excessive dark or colorful status.

Before the step S1, the method for adjusting the screen brightness further comprises the following steps.

In the step S0, a fixed ID number is assigned to each of a plurality of images in a system and the attribute parameter corresponding to the ID number of each image is stored. In the method, an ID number is correspondingly assigned to each of all the images in the smartphone before the step S1. When the user of the smartphone browses the images, the smartphone acquires the ID number of the corresponding image for fetching the image attribute parameter to be compared to the screen brightness.

Figure 2:
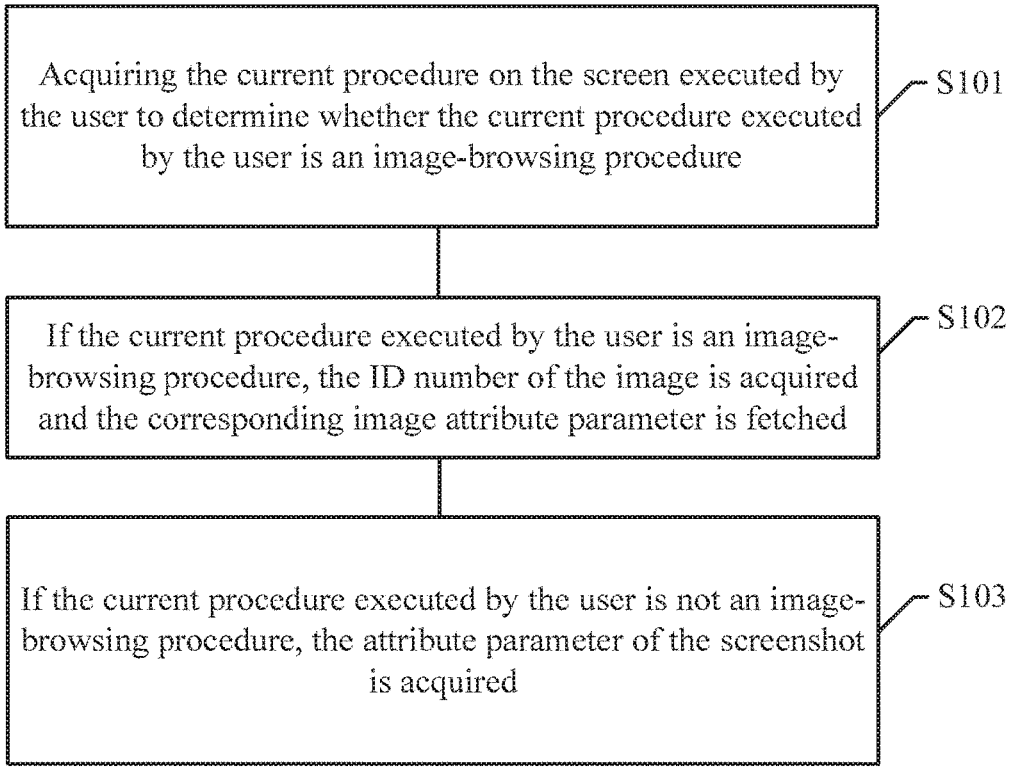
FIG. 2 is a flow chart of a method for acquiring the attribute parameter of the screen image according to one embodiment of the present invention.

Furthermore, FIG. 2 is a flow chart of a method for acquiring the attribute parameter of the screen image according to one embodiment of the present invention wherein the step S1 comprises the following steps.

In the step S101, the current procedure on the screen executed by the user is acquired to determine whether the current procedure executed by the user is an image-browsing procedure.

In the step S102, if the current procedure executed by the user is an image-browsing procedure, the ID number of the image is acquired and the corresponding image attribute parameter is fetched.

In the step S103, if the current procedure executed by the user is not an image-browsing procedure, the attribute parameter of the screenshot is acquired.

In the step S1 of the method, the image attribute on the screen is acquired to determine whether the current procedure executed by the user is an image-browsing procedure. If yes, the ID number of the image is acquired and the corresponding image attribute parameter is fetched. If not, e.g. reading e-Books or watching the video, the attribute parameter of the screenshot is fetched so that the screen image attribute is compared to the screen brightness to proceed the screen brightness adjustment no matter which procedure is used.

Figure 3:
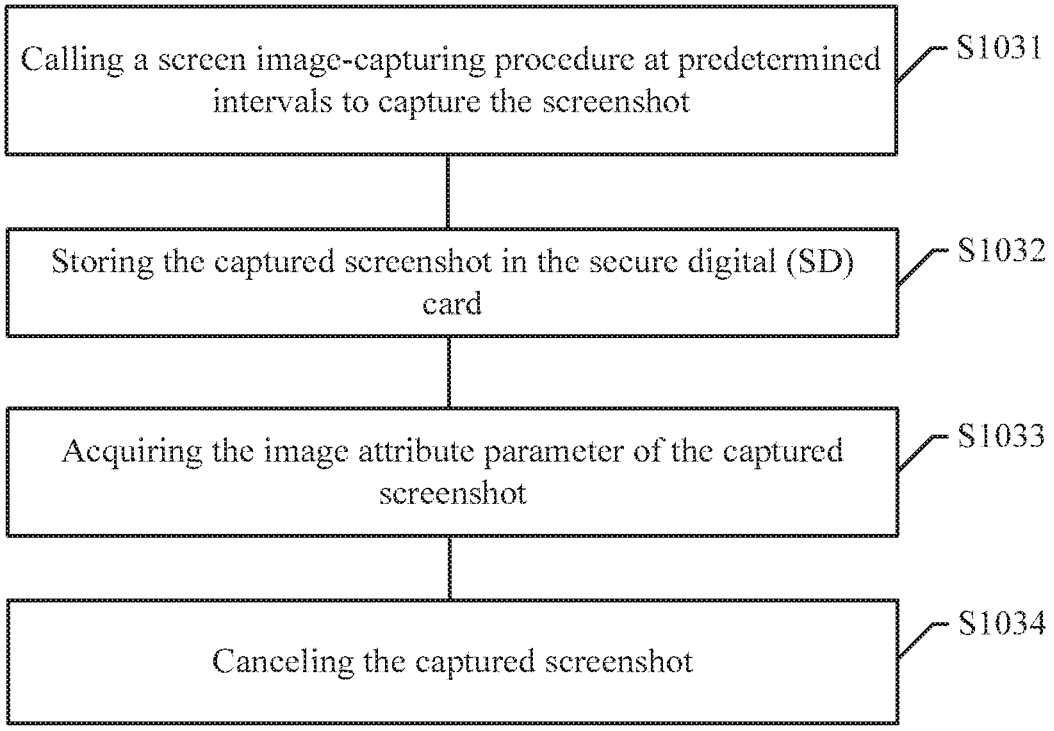
FIG. 3 is a flow chart of a method for acquiring the attribute parameters of the screenshot according to one embodiment of the present invention.

FIG. 3 is a flow chart of a method for acquiring the attribute parameters of the screenshot according to one embodiment of the present invention wherein the step S103 comprises the following steps.

In the step S1031, a screen image-capturing procedure is called at predetermined intervals to capture the screenshot.

In the step S1032, the captured screenshot is stored in the secure digital (SD) card.

In the step S1033, the image attribute parameter of the captured screenshot is acquired.

In the step S1034, the captured screenshot is canceled.

Figure 4:
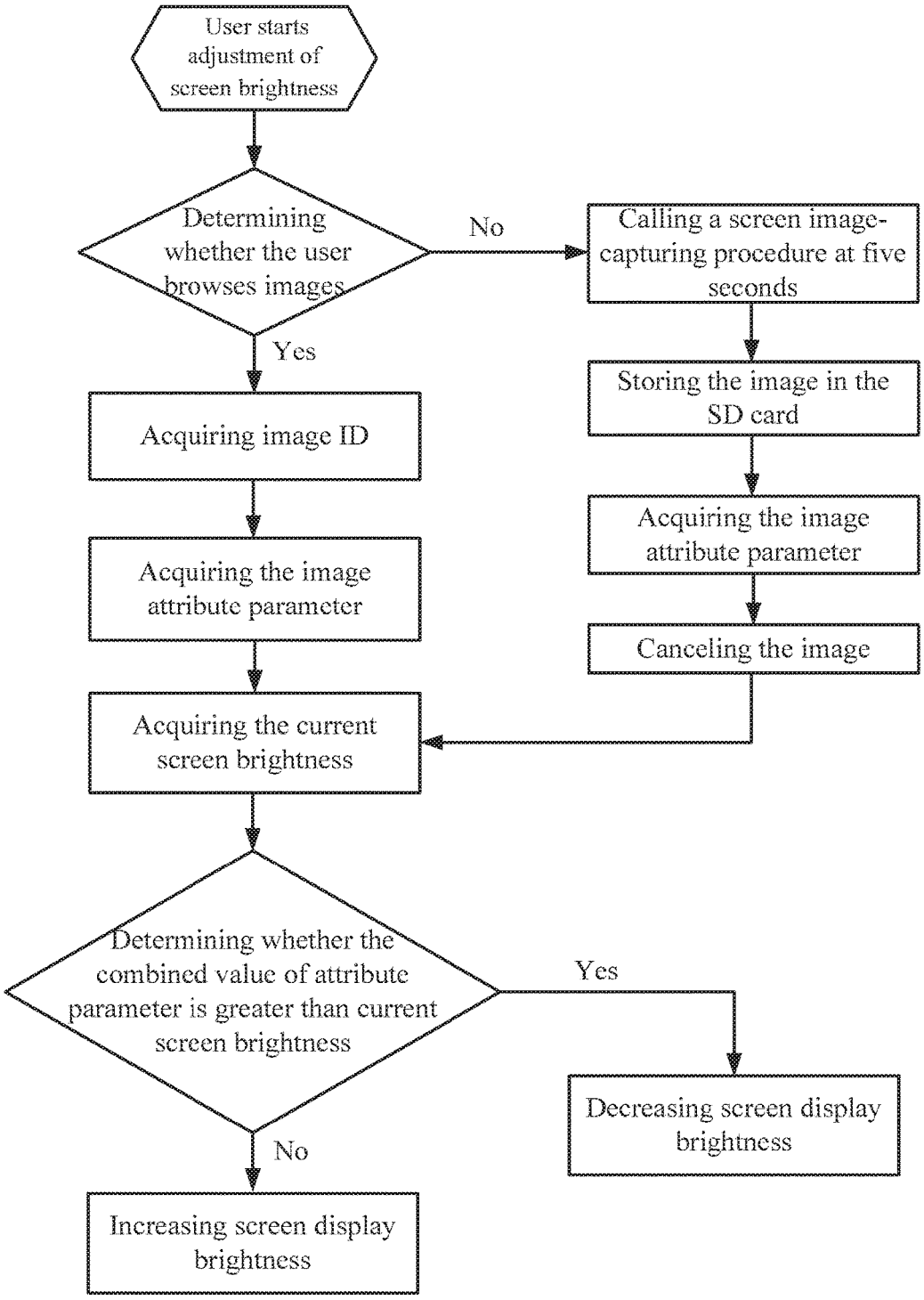
FIG. 4 is a flow block diagram of a method for acquiring the image attribute parameter of the screen image according to one embodiment of the present invention.

In the step S103, if the current procedure executed by the user is not an image-browsing procedure, the attribute parameter of the screenshot is fetched. The screen image-capturing procedure is called at appropriate intervals to capture the screenshot. In the present invention, since the screen brightness of the smartphone is adjusted in real time, the predetermined intervals should not to be so short. Preferably, the screen image-capturing procedure is called at five seconds to capture the screenshot. The captured screenshot e is then saved in the SD card. Afterwards, the image attribute parameter of the captured screenshot is acquired wherein the captured screenshot is used to identify the smartphone's screen which the user watches. The image attribute parameter of the captured screenshot is compared to the screen brightness in order to determine whether the current browsing page is too dark or colorful to be discomfort for the user's eyes. After the image attribute parameter of the captured screenshot is acquired, the captured screenshot is canceled to release the memory capacity of the smartphone. As shown in FIG. 4, it determines whether the current procedure executed by the user is the image-browsing procedure. First, the adjustment of the screen brightness starts. Second, it is determined whether the current procedure executed by the user is the image-browsing procedure. If yes, the ID number of the image is acquired and the corresponding image attribute parameter is fetched. If not, the attribute parameter of the screenshot is fetched. The attribute parameter of the screenshot is then compared to the screen brightness to adjust the screen brightness.

Furthermore, the image attribute parameter of the method for adjusting the screen brightness comprises contrast ratio, color tone and brightness. In the method of the present invention, the image attribute parameter comprises contrast ratio, color tone and brightness, which affects the visual results of the user. Generally speaking, as the vivid color raises, the higher the brightness becomes, which stimulates the user's eyes more and more intense. Meanwhile, it is required to decrease the screen brightness of the smartphone to balance the stimulation of the image to the user's eyes. On the contrary, the screen brightness is increased to reduce the visual fatigue while browsing the image.

In the method for adjusting the screen brightness, the user's reading content is roughly classified into the following three type: image (pictures), video and others, e.g. texts, browser and app programs. In the present invention, the user can employ the system settings, which is similar to the adjustment of the background light in the smartphone, to determine whether the brightness adjustment is started or not. If the user starts the adjustment function, the adjustment function is performed automatically when the "TP" is woken up. For an example of reading the image on the screen, first, a monitoring procedure is created to detect which image is called by "gallery" and the ID number of the image is acquired. In the Android operation system, the attribute parameter of each image is saved in the "exif" message of the following path. In the present invention, a plurality of parameter messages of the screen image attribute parameter are stored in the following codes:

packages/apps/Gallery2/gallerycommon/src/com/android/gallery3d/exif/ExifInterface.java, which comprises a portion of message represented by the following examples of codes:

```
public static final int TAG__BITS__PER__SAMPLE =
defineTag(IfdId.TYPE__IFD__0, (short) 0x0102);
public static final int TAG__COMPRESSION =
defineTag(IfdId.TYPE__IFD__0, (short) 0x0103);
public static final int TAG__PHOTOMETRIC__INTERPRETATION =
defineTag(IfdId.TYPE__IFD__0, (short) 0x0106);
public static final int TAG__MODEL =
public static final int TAG__ROWS__PER__STRIP =
defineTag(IfdId.TYPE__IFD__0, (short) 0x0116);
public static final int TAG__STRIP__BYTE__COUNTS =
defineTag(IfdId.TYPE__IFD__0, (short) 0x0117);
public static final int TAG__X__RESOLUTION =
defineTag(IfdId.TYPE__IFD__0, (short) 0x011A);
public static final int TAG__Y__RESOLUTION =
defineTag(IfdId.TYPE__IFD__0, (short) 0x011B);
public static final int TAG__LIGHT__SOURCE =
defineTag(IfdId.TYPE__IFD__EXIF, (short) 0x9208);
public static final int TAG__COLOR__SPACE =
defineTag(IfdId.TYPE__IFD__EXIF, (short) 0xA001);
public static final int TAG__CONTRAST =
defineTag(IfdId.TYPE__IFD__EXIF, (short) 0xA408);
```

The present invention acquires the image attribute parameters by way of the following method:

public static void extractExifInfo(MediaDetails details, String filePath)

wherein the parameters comprising the contrast ratio, color tone and brightness affect the visual results of the user and the method can be performed by the following codes:

```
public static void extractExifInfo(MediaDetails details, String filePath) {
try {
ExifInterface exif = new ExifInterface(filePath); //define the path of an
"exif" document;
```

-continued

```
setExifData(details,exif,ExifInterface.TAG__FLASH,MediaDetails.INDEX__FLASH);
//read the flash of the "exif" document;
setExifData(details,exif,ExifInterface.TAG__IMAGE__WIDTH,MediaDetails.INDEX__WIDTH);
// read the width and breadth of the "exif" document;
setExifData(details,exif,ExifInterface.TAG__IMAGE__LENGTH,MediaDetails.INDEX__HEIGHT);
// read the height of the "exif" document;
setExifData(details,exif,ExifInterface.TAG__MAKE,MediaDetails.INDEX__MAKE);//
read the make or aspect of the "exif" document;
setExifData(details,exif,ExifInterface.TAG__MODEL,MediaDetails.INDEX__MODEL);
// read the model of the "exif" document;
setExifData(details,exif,ExifTags.TAG__APERTURE,MediaDetails.INDEX__APERTURE);
// read the aperture of the "exif" document;
setExifData(details, exif, ExifTags.TAG__ISO, MediaDetails.INDEX__ISO);
// read the ISO sensitivity of the "exif" document;
setExifData(details, exif, ExifInterface.TAG__WHITE__BALANCE,
MediaDetails.INDEX__WHITE__BALANCE); // read the white balance of the "exif"
document;
setExifData(details, exif, ExifTags.TAG__EXPOSURE__TIME,
MediaDetails.INDEX__EXPOSURE__TIME); // read the exposure time of the "exif"
document;
Double
data=exif.getAttributeDouble(ExifInterface.TAG__FOCAL__LENGTH, 0); //inquire
the related attributes of the document and convert the data type into "double" type;
if (data != of) {
details.addDetail(MediaDetails.INDEX__FOCAL__LENGTH, data);
details.setUnit(MediaDetails.INDEX__FOCAL__LENGTH,
R.string.unit__mm);
} //if the data is not "of", the data are added to the detail string media of
the document;
} catch (IOException ex) {
// ignore it.
Log.w(TAG, "", ex);
}
}
```

The above-mentioned codes illustrates how to acquire the relate attributes values in the "exif" document without a detailed description of these codes of the parameters.

If the current procedure executed by the user is not an image-browsing procedure, the screen image-capturing procedure, e.g. a capturing function "GlobalScreenshot_2(Context)", is called every five seconds to capture the screen image wherein the capturing function in the native codes of the Android operating system comprises a window for dynamically displaying an image-capturing process and a suspension window for displaying the image. In order to improve the user experience of the present invention, the capturing function "GlobalScreenshot_2(Context)" is replaced by a portion of codes described as follows. Some codes associated with windows codes are canceled to assure no window for dynamically displaying an image-capturing process after capturing and storing the image and no suspension window so as to avoid the user experience.

After the captured screenshot is stored, the parameter associated with the captured screenshot is read by the same manner as the image attribute parameter is acquired, the screen brightness is then adjusted automatically and the captured screenshot is finally canceled. This software performing process is depicted as FIG. 1.

The present invention utilizes an integrated calculation to generate a combined value related to color tone and brightness of the current image and the combined value is compared to the screen brightness to determine whether to increase or decrease the screen brightness. For example, the function "setScreenBrightness(int brightness)" is used to adjust the brightness value.

```
// Setup the window that we are going to use
mWindowLayoutParams = new WindowManager.LayoutParams(
ViewGroup.LayoutParams.MATCH__PARENT,
ViewGroup.LayoutParams.MATCH__PARENT, 0, 0,
WindowManager.LayoutParams.TYPE__SECURE__SYSTEM__OVERLAY,
WindowManager.LayoutParams.FLAG__FULLSCREEN
| WindowManager.LayoutParams.FLAG__HARDWARE__ACCELERATED
WindowManager.LayoutParams.FLAG__LAYOUT__IN__SCREEN
WindowManager.LayoutParams.FLAG__SHOW__WHEN__LOCKED,
PixelFormat.TRANSLUCENT);
mWindowLayoutParams.setTitle("ScreenshotAnimation");//
```

```
/**
* Sets the display brightness.
*
* @param brightness The brightness, ranges from 0 (minimum / off) to
255 (brightest).
*/
public void setScreenBrightness(int brightness) {
if (mScreenBrightness != brightness) {//determine whether the current
brightness of the smartphone is equal to the predetermined brightness. If not,
performing the following codes//
if (DEBUG) {
Slog.d(TAG, "setScreenBrightness: brightness=" + brightness);
}//print the log message of "debug": the desired predetermined
brightness//
mScreenBrightness = brightness; //assign the predetermined brightness to
"mscreenbrightness"//
if (mScreenOn) {
mScreenReady = false;
scheduleScreenUpdate( );//if the screen is switched on, refreshing the
screen brightness//
}
}
}
}
```

The method of setting the brightness is provided above and will not be repeated here in detail.

Figure 5:
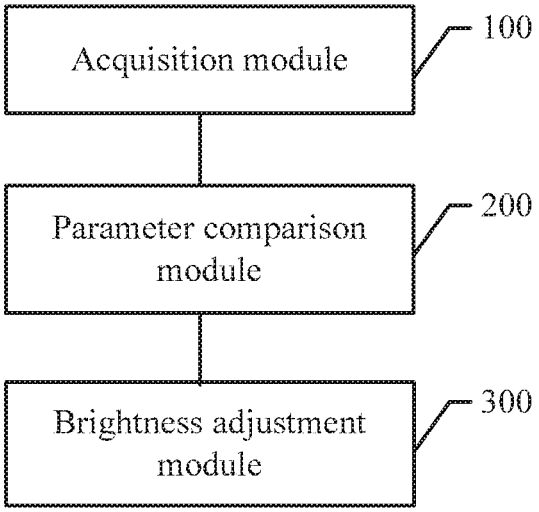
FIG. 5 is a schematic block diagram of a system for adjusting the screen brightness according to one embodiment of the present invention.

Moreover, FIG. 5 is a schematic block diagram of a system for adjusting the screen brightness according to one embodiment of the present invention wherein the system comprises:

an acquisition module 100 for acquiring current screen image attribute parameter and the screen brightness;

a parameter comparison module 200 for comparing the current screen image attribute parameter to the screen brightness; and a brightness adjustment module 300. When the value of the current screen image attribute parameter is greater than the screen brightness, the brightness adjustment module 300 decreases the screen display brightness associated with the attribute parameter for equalizing the image attribute parameter after the parameter adjustment to the screen brightness before the brightness adjustment. When the value of the current screen image attribute parameter is less than the screen brightness, the brightness adjustment module 300 decreases the screen display brightness for equalizing the image attribute parameter after the parameter adjustment to the screen brightness before the brightness adjustment.

Moreover, the system for adjusting the screen brightness further comprises a parameter storing module 400 for assigning a fixed ID number to each of all the images and for storing the image attribute parameter of each image.

Figure 6:
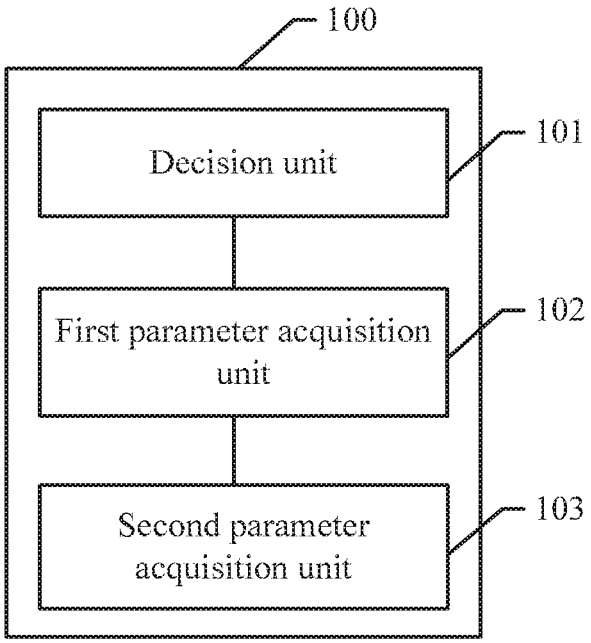
FIG. 6 is a schematic block diagram of an acquisition module of the system for adjusting the screen brightness according to one embodiment of the present invention.

Additionally, FIG. 6 is a schematic block diagram of an acquisition module of the system for adjusting the screen brightness according to one embodiment of the present invention wherein the acquisition module 100 comprises:

a decision unit 101 for acquiring the current procedure on the screen executed by the user to determine whether the current procedure executed by the user is an image-browsing procedure;

a first parameter acquisition unit 102 for acquiring the ID number of the image and the corresponding image attribute parameter if the user is browsing the image; and a second parameter acquisition unit 103 for acquiring the attribute parameter of the screenshot image if the user is not browsing the image.

Figure 7:
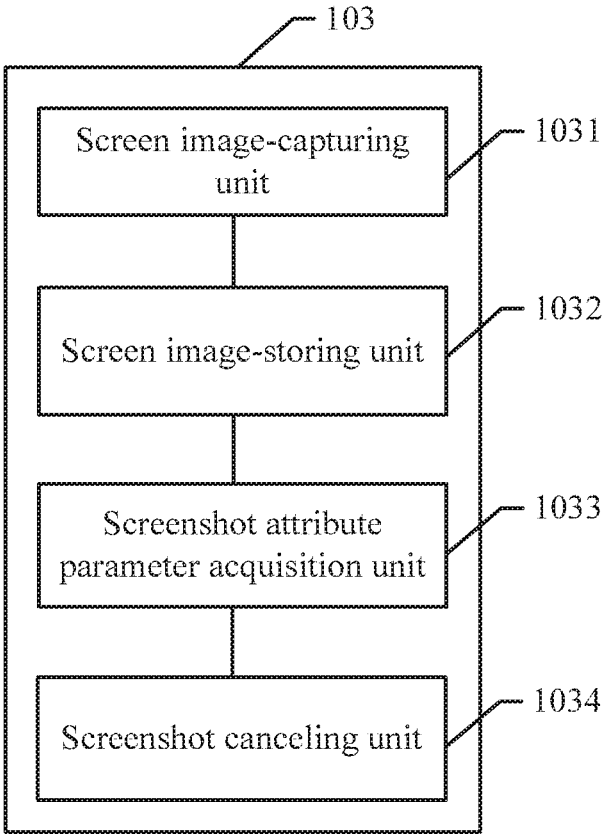
FIG. 7 is a schematic block diagram of a second parameter acquisition unit of the system for adjusting the screen brightness according to one embodiment of the present invention.

Furthermore, FIG. 7 is a schematic block diagram of a second parameter acquisition unit of the system for adjusting the screen brightness according to one embodiment of the present invention. The second parameter acquisition unit 103 comprises:

a screen image-capturing unit 1031 for calling a screen image-capturing procedure at predetermined intervals to capture the screenshot;

a screen image-storing unit 1032 for storing the captured screenshot in the SD card;

a screenshot attribute parameter acquisition unit 1033 for acquiring the image attribute parameter of the captured screenshot; and a screenshot canceling unit 1034 for canceling the captured screenshot.

Furthermore, the image attribute parameter of the system for adjusting the screen brightness comprises contrast ratio, color tone and brightness.

The modules of the system are described in the aforementioned method and thus will not be repeated here in detail.

According to the above-mentioned descriptions, the present invention acquires screen image or screenshot of the smartphone. If the user is browsing the image, the ID number of the image is acquired to fetch the corresponding image attribute parameter. If the user is not browsing the image, the screenshot image is captured at predetermined intervals, the attribute parameter of the screenshot is fetched and the screenshot image is then canceled. The attribute parameter of the acquired screen image of the smartphone is compared to the current screen brightness. When the value of the current screen image attribute parameter is greater than the screen brightness, the screen display brightness is decreased and when the value of the current screen image attribute parameter is less than the screen brightness, the screen display brightness is increased. These assure that the screen brightness is intelligently adjusted based on the user's browsing content to modify the screen brightness to best suit user's viewing brightness in order to protect the user's eyes when the user utilizes the smartphone.

As is understood by a person skilled in the art, the foregoing preferred embodiments of the present invention are illustrative rather than limiting of the present invention. It is intended that they cover various modifications and similar arrangements be included within the spirit and scope of the present invention, the scope of which should be accorded the broadest interpretation so as to encompass all such modifications and similar structures.

What is claimed is:

1. A method for adjusting screen brightness, the method comprising the steps of:

assigning a fixed ID number to each of a plurality of images in a system and storing an attribute parameter corresponding to the fixed ID number of each image;

acquiring an attribute parameter of an image currently displayed on a screen and a screen brightness of the screen;

comparing the attribute parameter of the image currently displayed on the screen to the screen brightness; and decreasing the screen brightness for equalizing the attribute parameter of the image currently displayed on the screen after a parameter adjustment to the screen brightness before a brightness adjustment when the attribute parameter of the image currently displayed on the screen is greater than the screen brightness; and increasing the screen brightness for equalizing the attribute parameter of the image currently displayed on the screen after the parameter adjustment to the screen brightness before the brightness adjustment when the attribute parameter of the image currently displayed on the screen is less than the screen brightness; wherein during the step of acquiring the attribute parameter of the image currently displayed on the screen, further comprising the steps of:

acquiring a current procedure on the screen executed by a user and the screen brightness and determining whether the current procedure executed by the user is an image-browsing procedure;

acquiring a fixed ID number of the image currently displayed on the screen and acquiring the attribute parameter corresponding to the image currently displayed on the screen based on the fixed ID number of the image currently displayed on the screen if the current procedure executed by the user is the image-browsing procedure; and acquiring an attribute parameter of a screenshot if the current procedure executed by the user is not the image-browsing procedure.

2. The method for adjusting screen brightness of claim 1, during the step of acquiring the attribute parameter of the screenshot if the current procedure executed by the user is not the image-browsing procedure, further comprising the steps of:

calling a screen image-capturing procedure at predetermined intervals to capture the screenshot;

storing the captured screenshot in a SD card;

acquiring the attribute parameter of the captured screenshot; and canceling the captured screenshot.

3. The method for adjusting screen brightness of claim 1, wherein the attribute parameter of the image currently displayed on the screen comprises a contrast ratio, a color tone and a brightness.

4. A non-transitory storage medium storing instructions thereon which are executed by a processor, wherein the instructions executed by the processor perform the operations of:

assigning a fixed ID number to each of a plurality of images in a system and storing an attribute parameter corresponding to the fixed ID number of each image;

acquiring an attribute parameter of an image currently displayed on a screen and a screen brightness of the screen;

comparing the attribute parameter to the screen brightness; and decreasing the screen brightness for equalizing the attribute parameter after a parameter adjustment to the screen brightness before a brightness adjustment when the attribute parameter is greater than the screen brightness; and increasing the screen brightness for equalizing the attribute parameter after the parameter adjustment to the screen brightness before the brightness adjustment when the attribute parameter is less than the screen brightness; wherein when the processor performs the operation of acquiring the attribute parameter of the image currently displayed on the screen, the processor further performs the operations of:

acquiring a current procedure on the screen executed by a user and determining whether the current procedure executed by the user is an image-browsing procedure;

acquiring the fixed ID number of the image currently displayed on the screen and acquiring an attribute parameter corresponding to the image currently displayed on the screen based on the fixed ID number of the image currently displayed on the screen if the current procedure executed by the user is the image-browsing procedure; and acquiring an attribute parameter of a screenshot if the current procedure executed by the user is not the image-browsing procedure.

5. The non-transitory storage medium storing instructions thereon which are executed by the processor of claim 4, wherein when the processor performs the operation of acquiring the attribute parameter of the screenshot, the processor further performs the operations of:

calling a screen image-capturing procedure at predetermined intervals to capture the screenshot;

storing the captured screenshot in a SD card;

acquiring the attribute parameter of the captured screenshot; and canceling the captured screenshot.

6. The non-transitory storage medium of claim 4, wherein the attribute parameter of the image currently displayed on the screen comprises a contrast ratio, a color tone and a brightness.

* * * * *